US008039091B2

(12) United States Patent
Tilton et al.

(10) Patent No.: US 8,039,091 B2
(45) Date of Patent: Oct. 18, 2011

(54) DECORATIVE PANEL WITH SURFACE PRINTING

(75) Inventors: Jeffrey A. Tilton, Prospect, KY (US); Clarke Berdan, II, Granville, OH (US); Jerry M. Parks, Granville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 249 days.

(21) Appl. No.: 10/421,565

(22) Filed: Apr. 23, 2003

(65) Prior Publication Data

US 2004/0213964 A1 Oct. 28, 2004

(51) Int. Cl.
*B41M 5/00* (2006.01)

(52) U.S. Cl. ..... 428/195.1; 428/218; 442/390; 442/392

(58) Field of Classification Search ..... 428/220, 428/332, 359, 364, 392, 395, 400, 114, 218, 428/198, 288, 36.91, 516, 195.1, 17; 442/381, 442/56, 390, 392, 76, 414, 361, 364
See application file for complete search history.

(56) References Cited

U.S. PATENT DOCUMENTS

| | | | | |
|---|---|---|---|---|
| 2,612,462 | A | | 9/1952 | Zettel |
| 2,851,730 | A | | 9/1958 | Wilhelmi et al. |
| 3,096,879 | A | | 7/1963 | Schumacher |
| 3,344,973 | A | | 10/1967 | Studen |
| 3,404,748 | A | | 10/1968 | Bjorksten |
| 3,581,453 | A | | 6/1971 | Jones et al. |
| 3,835,604 | A | | 9/1974 | Hoffmann |
| 3,882,216 | A | | 5/1975 | Delanty et al. |
| 3,907,193 | A | | 9/1975 | Heller |
| 4,103,062 | A | * | 7/1978 | Aberson et al. ..... 442/417 |
| 4,131,664 | A | | 12/1978 | Flowers et al. |
| 4,135,024 | A | * | 1/1979 | Callahan et al. ..... 428/171 |
| 4,175,148 | A | | 11/1979 | Luck et al. |
| 4,213,516 | A | | 7/1980 | Sulewsky |
| 4,230,753 | A | | 10/1980 | Sheyon |
| 4,283,445 | A | * | 8/1981 | Bartholl ..... 428/17 |
| 4,377,615 | A | | 3/1983 | Suzuki et al. |
| 4,428,454 | A | | 1/1984 | Capaul et al. |
| 4,430,286 | A | | 2/1984 | Franz |
| 4,539,252 | A | | 9/1985 | Franz |
| 4,588,457 | A | * | 5/1986 | Crenshaw et al. ..... 156/62.8 |
| 4,624,083 | A | | 11/1986 | Diffrient |

(Continued)

FOREIGN PATENT DOCUMENTS

DE 196 16 672 10/1997

(Continued)

OTHER PUBLICATIONS

US -03-0068943A1 Apr. 2003 Fay 442/76.*

(Continued)

*Primary Examiner* — Larry Tarazano
*Assistant Examiner* — Tamra Amakwe
(74) *Attorney, Agent, or Firm* — Calfee, Halter & Griswold LLP

(57) ABSTRACT

A decorative panel includes a body constructed from a single layer of a polymer based blanket material having a surface zone. Printing is directly applied to an exposed face of that surface zone. The surface zone may be densified relative to the remainder of the body to tune the acoustical and physical properties of the panel for a particular application and/or to allow for high definition printing.

27 Claims, 1 Drawing Sheet

U.S. PATENT DOCUMENTS

| | | | | | |
|---|---|---|---|---|---|
| 4,627,199 | A | | 12/1986 | Capaul | |
| 4,711,685 | A | | 12/1987 | Hillman et al. | |
| 4,914,767 | A | * | 4/1990 | Balicki et al. | 5/419 |
| 4,946,738 | A | | 8/1990 | Chenoweth et al. | |
| 5,149,920 | A | | 9/1992 | Meeker et al. | |
| 5,221,573 | A | * | 6/1993 | Baigas, Jr. | 428/212 |
| 5,298,319 | A | | 3/1994 | Donahue et al. | |
| 5,339,730 | A | * | 8/1994 | Ruppel et al. | 101/32 |
| 5,372,885 | A | * | 12/1994 | Tabor et al. | 428/373 |
| 5,421,133 | A | | 6/1995 | Berdan et al. | |
| 5,436,046 | A | * | 7/1995 | Sakamoto | 428/36.2 |
| 5,451,437 | A | | 9/1995 | Insley et al. | |
| 5,458,590 | A | * | 10/1995 | Schleinz et al. | 604/361 |
| 5,492,662 | A | | 2/1996 | Kargol et al. | |
| 5,501,898 | A | | 3/1996 | Fottinger et al. | |
| 5,503,076 | A | * | 4/1996 | Yeo | 101/483 |
| 5,616,418 | A | * | 4/1997 | Vasselin et al. | 428/474.7 |
| 5,629,005 | A | * | 5/1997 | Brassington et al. | 424/402 |
| 5,674,591 | A | * | 10/1997 | James et al. | 428/156 |
| 5,804,512 | A | * | 9/1998 | Lickfield et al. | 442/346 |
| 5,817,408 | A | | 10/1998 | Orimo et al. | |
| 5,823,611 | A | | 10/1998 | Daniel et al. | |
| 5,833,304 | A | | 11/1998 | Daniel et al. | |
| 5,841,081 | A | * | 11/1998 | Thompson et al. | 181/286 |
| 5,886,306 | A | | 3/1999 | Patel et al. | |
| RE36,323 | E | | 10/1999 | Thompson et al. | |
| 6,066,388 | A | * | 5/2000 | Van Kerrebrouck | 428/218 |
| 6,123,171 | A | | 9/2000 | McNett et al. | |
| 6,217,691 | B1 | | 4/2001 | Vair, Jr. et al. | |
| 6,321,871 | B1 | | 11/2001 | Russell | |
| 6,345,688 | B1 | | 2/2002 | Veen et al. | |
| 6,358,592 | B2 | | 3/2002 | Vair, Jr. et al. | |
| 6,372,870 | B1 | * | 4/2002 | Kitahara et al. | 526/250 |
| 6,420,013 | B1 | * | 7/2002 | Vinson et al. | 428/154 |
| 6,436,512 | B1 | * | 8/2002 | Kauschke et al. | 428/170 |
| 6,443,256 | B1 | | 9/2002 | Baig | |
| 6,459,016 | B1 | * | 10/2002 | Rosenfeld et al. | 604/378 |
| 6,538,084 | B2 | * | 3/2003 | Kitahara et al. | 526/250 |
| 6,572,575 | B1 | | 6/2003 | Shimada et al. | |
| 6,610,390 | B1 | * | 8/2003 | Kauschke et al. | 428/198 |
| 6,669,265 | B2 | | 12/2003 | Tilton et al. | |
| 6,726,980 | B2 | | 4/2004 | Staelgraeve et al. | |
| 6,746,766 | B2 | * | 6/2004 | Bond et al. | 428/370 |
| 6,756,332 | B2 | | 6/2004 | Sandoe et al. | |
| 6,770,339 | B2 | | 8/2004 | Teague et al. | |
| 6,875,315 | B2 | | 4/2005 | Bakken et al. | |
| 6,878,238 | B2 | * | 4/2005 | Bakken et al. | 162/362 |
| 6,878,427 | B2 | | 4/2005 | Schmidt et al. | |
| 6,890,622 | B2 | * | 5/2005 | Adam et al. | 428/171 |
| 6,893,711 | B2 | | 5/2005 | Williamson et al. | |
| 6,900,147 | B2 | | 5/2005 | Morman et al. | |
| 6,921,570 | B2 | * | 7/2005 | Belau et al. | 428/103 |
| 6,925,765 | B2 | | 8/2005 | Fay et al. | |
| 2001/0050139 | A1 | | 12/2001 | Vair, Jr. et al. | |
| 2002/0099347 | A1 | * | 7/2002 | Chen et al. | 604/369 |
| 2002/0107495 | A1 | * | 8/2002 | Chen et al. | 604/365 |
| 2002/0117352 | A1 | | 8/2002 | Veen et al. | |
| 2002/0123289 | A1 | | 9/2002 | DeAngelis et al. | |
| 2003/0008093 | A1 | | 1/2003 | Ray et al. | |
| 2003/0008581 | A1 | | 1/2003 | Tilton et al. | |
| 2003/0066708 | A1 | | 4/2003 | Allison et al. | |
| 2003/0068943 | A1 | | 4/2003 | Fay | |
| 2003/0082387 | A1 | | 5/2003 | Arndt et al. | |
| 2004/0002274 | A1 | * | 1/2004 | Tilton | 442/381 |

FOREIGN PATENT DOCUMENTS

| | | |
|---|---|---|
| EP | 002256020 | 8/1996 |
| EP | 0 909 680 | 4/1999 |
| WO | WO 97/06320 | 2/1997 |
| WO | 2004/094164 | 11/2004 |

OTHER PUBLICATIONS

US 03-0008093 A1 Jan. 2003 Ray et al 428/36.91.*

International Search report PCT/US2004/042517 dated Apr. 1, 2005.

Office action from European Application No. 04729627.8 dated Mar. 26, 2009.

International Search Report and Written Opinion from PCT/US04/10053 dated Mar. 23, 2005.

* cited by examiner

DECORATIVE PANEL WITH SURFACE PRINTING

TECHNICAL FIELD AND INDUSTRIAL APPLICABILITY OF THE INVENTION

The present invention relates generally to the field of insulation products and, more particularly, to a decorative panel constructed from a single layer of a polymer based blanket material and including printing directly on a surface thereof.

BACKGROUND OF THE INVENTION

Laminate materials of various polymers including but not limited to polyester, polypropylene, polyethylene, nylon and rayon, as well as natural fibers and fiberglass are known to be useful for a number of purposes. Exemplary of the many applications for these materials include office screens and partitions, ceiling tiles, building panels and various vehicle applications including as hood liners, head liners, floor liners and trim panels. Generally, where such laminated materials are going to be highly visible, they are decorated with a fabric facing material. For example, U.S. Pat. No. 4,624,083 to Diffrient discloses an office panel or screen including a three-ply corrugated cardboard sheet septum disposed between two sound insulation pads or panels all covered with decorative fabric.

While such a fabric covering enhances the aesthetic quality of the resulting product, it must be appreciated that it adds significantly to the overall cost of production. Naturally, these added costs must be passed along to the consumer. Further, fabric coverings generally add nothing to the structural as well as the sound and thermal insulating properties of the product.

One approach for addressing this problem is set forth in copending U.S. patent application Ser. No. 10/185,220, filed Jun. 27, 2002, entitled "Decorative Laminate For Fibrous Insulation Products" owned by the assignee of the present invention (OC case #25204). The panel described in this document incorporates a base layer of fibers and a separate facing layer of densified polyester fibers that not only enhances the rigidity and sound attenuating properties of the base acoustical insulating layer but also bears printed patterns, designs, graphics or other indicia on an exposed face thereof so as to display an aesthetically pleasing appearance. This enhanced aesthetic appearance is achieved sans a decorative fabric covering thereby substantially reducing overall production costs.

The present invention relates to yet another improvement. The panel of the present invention is formed from a single layer of fibers that may or may not have a densified surface zone. Printing is directly applied to this surface zone. Advantageously, since there is no lamination step, any risk for delamination of the product is avoided. Production costs and product complexity are reduced while product integrity is enhanced for a longer service life.

SUMMARY OF THE INVENTION

In accordance with the purposes as described herein a decorative panel is provided. The panel comprises a body constructed from a single layer of a polymer based blanket material. The body includes a surface zone and printing directly applied to the exposed face of that surface zone. If desired, in order to tune the acoustical properties of the panel and/or enhance the definition of the printing, the surface zone may be densified.

The polymer based blanket material may be selected from a group of materials consisting of polyester, polyolefin, polypropylene, polyethylene, fiberglass, acrylic, natural fibers, nylon, rayon and blends thereof. In one particular embodiment the polymer based blanket material comprises polyester staple fibers and polyester bicomponent fibers. The polyester staple fibers and polyester bicomponent fibers have diameters of between about 8.0 to about 30.0 microns and lengths between about 1.25 and about 8.0 cm. The polymer based blanket material may include meltblown microfibers.

Typically the surface zone is densified and has a density of between about 1.5 and 15.0 lbs/ft$^3$. Further, the densified surface zone has a thickness of between about 0.038 and about 0.38 cm. The decorative panel of the present invention may be defined in the alternative as comprising a body constructed from a single layer of a polymer based blanket material including a densified surface zone having a first density A, a base zone having a density B and an intermediate zone between the surface zone and base zone having a density C where A>C>B. The panel is further characterized by printing directly applied to the exposed surface of the densified surface zone.

The densified surface zone has a thickness of between about 0.038 and about 0.38 cm. The base zone has a thickness of between about 0.38 and about 5.0 cm. The intermediate zone has a thickness of between about 0.12 and about 1.3 cm.

The densified surface zone includes fibers having a diameter D, the base zone includes fibers having a diameter E and the intermediate zone includes fibers having a diameter F where F>E>D. More specifically, the densified surface zone includes fibers having a diameter of between about 5.0 to about 25.0 microns and a length of between about 1.27 to about 6.35 cm. The base zone includes fibers having a diameter of between about 10.0 and about 50.0 microns and a length of between about 2.54 and about 7.6 cm. The intermediate zone includes fibers having a diameter of between about 10.0 and about 50.0 microns and a length of between about 2.54 and about 7.62 cm.

In the following description there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
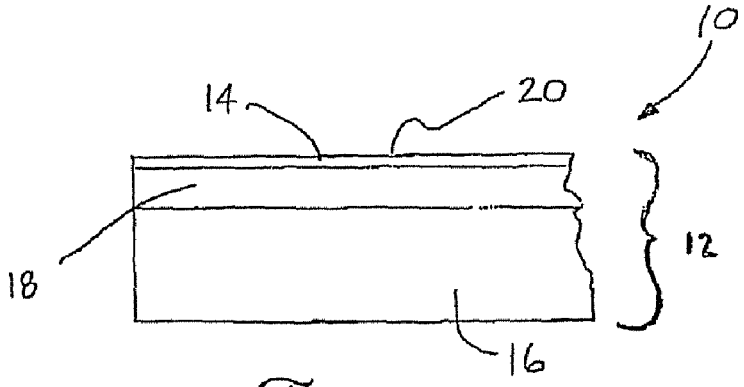
FIG. 1 is a schematical end elevational representation of the decorative panel of the present invention which may take the form of a partition panel or a ceiling tile.
Figure 2:
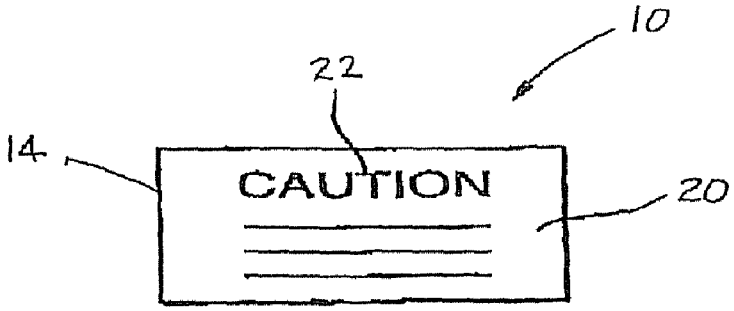
FIG. 2 is a schematical top plan view showing the exposed printed face of the facing layer of the decorative panel shown in FIG. 1.

Reference is now made to FIG. 1 showing the decorative panel 10 of the present invention. As described and illustrated that decorative panel 10 takes the form of a partition panel or ceiling tile. It should be appreciated, however, that these are just two possible applications for the decorative panel 10 of the present invention and that they should be considered as being merely illustrative in nature rather than limiting in scope. Exemplary of other possible products of the present invention are hood liners, head liners, trim panels, vehicle sun visors, building panels, basement finishing systems, bulletin boards, business cards, display boards, picture frames and storage boxes.

As illustrated, the decorative panel 10 is constructed from a single layer 12 of polymer based blanket material having fibers exhibiting desirable acoustical and/or thermal insulating properties as well as moisture wicking. Those fibers may be selected from a group consisting of polyester, polyolefin, polypropylene, polyethylene, fiberglass, acrylic, natural fibers such as kenaf and cotton, nylon, rayon and blends thereof. As illustrated, the layer 12 of polymer based blanket material includes a surface zone 14, a base zone 16 and an intermediate zone 18. The exposed face 20 of the surface zone 14 bears printing 22. Advantageously, the surface zone 14 may be densified relative to the base zone 16 and intermediate zone 18 if desired so as to make the face 20 particularly smooth thereby allowing high definition printing/coloring. The face 20 may also be water and stain resistant.

The printing 22 on the exposed face 20 may take substantially any form such as a landscape graphic, a natural wood or stone image, a design, a pattern or indicia. The printing may even take the form of a product warning such as commonly found in automobiles or around other machinery. In essence, substantially any image that may be printed can be used.

As noted above, the polymer based blanket material may be selected from a group of materials consisting of polyester, polyolefin, polypropylene, polyethylene, fiberglass, acrylic, natural fibers, nylon, rayon and blends thereof. One example of a commonly used polymer based blanket material includes both polyester staple fibers and polyester bicomponent fibers. The polyester staple fibers and polyester bicomponent fibers may have diameters of between about 8.0 to about 50.0 microns and lengths between about 1.25 and 8.0 cm. The polymer based blanket material may include meltblown microfibers if desired. The polymer based blanket material may also include a targeted amount of fire retardant fibers.

In a typical embodiment the densified surface zone 14 has a first density A, the base zone 16 has a second density B and the intermediate zone 18 has a third density C where A>C>B. More specifically, the densified surface zone 14 has a density of between about 1.5 pcf and about 15.0 pcf. The base zone 16 has a density of between about 0.5 pcf and about 10.0 pcf. The intermediate zone 18 has a density of between about 0.5 pcf and about 10.0 pcf.

The densified surface zone 14 has a thickness of between about 0.038 and about 0.38 cm. The base zone 16 has a thickness of between about 0.38 and about 5.08 cm. The intermediate zone 18 has a thickness of between about 0.127 and about 1.27 cm.

Additionally, the densified surface zone 14 includes fibers having a diameter D. The base layer 16 includes fibers having a diameter E and the intermediate zone 18 includes fibers having a diameter F where F>E>D. More specifically, the densified surface zone 14 includes fibers having a diameter of between about 5.0 to about 25.0 microns and a length of between about 1.27 to about 6.35 cm. The base zone 16 includes fibers having a diameter of between about 10.0 and about 50.0 microns and a length of between about 2.54 and about 7.62 cm. The intermediate zone 18 includes fibers having a diameter of between about 10.0 and about 50.0 microns and a length of between about 2.54 and about 7.62 cm.

It should be appreciated that the present invention represents a significant advance in the art. Advantageously, the performance characteristics of the panel 10 may be tuned in order to obtain the tackability, NRC and printability properties required for a multitude of different applications. The layer 12 of polymer based blanket material may be subjected to differential densification as taught in copending U.S. patent application Ser. No. 10/040,697, filed Nov. 9, 2001 and entitled "Multidensity Liner/Insulator" (OC Case No. 24981). This allows the panel 10 of the present invention to meet various acoustical, rigidity, tackability and printability requirements. The density, thickness, fiber diameter and fiber chemical composition of the zones may be altered in order to meet this end. For example, the base zone 16 could be of low density and include medium fiber diameters to economically provide good acoustical properties. The intermediate zone 18 could be of medium density and incorporate coarse fibers to economically provide desired stiffness and tackability. The surface zone 14 could be very thin and incorporate a high density of fine fibers to provide a superior printing surface. Any or all of the zones could have a targeted amount of fire retardant fibers if desired.

It should also be appreciated that when the surface zone 14 is constructed from polyester fibers having an average fiber diameter of between about 10 and about 50 microns and, more typically, about 10 and about 30 microns that are densified to a density of between about 1.5 pcf and about 15.0 pcf, the surface zone advantageously provides an airflow resistance of between about 10,000 and about 1,000,000 mks rayls/meter. Thus, the surface zone 14 has many advantages over paper and other film facing layers commonly utilized in the art since it retains some degree of air porosity. This provides an acoustic benefit over solid, non-porous films.

In fact, the acoustical properties of the panel 10 may be tuned to absorb and/or reflect various frequency ranges by changing the porosity properties of the surface zone 14. Thickness, density and fiber formulation can all be utilized to tune the acoustics to provide better overall sound attenuating properties for any particular application. Papers, fabrics and films generally utilized as decorative facings in office panels, basement finishing systems and ceiling tiles known in the art lack the ability to significantly enhance the acoustics of the finished product. Further, these prior art facings and fabrics are expensive and time consuming to install onto board products thereby significantly increasing production costs.

A number of different techniques may be utilized to manufacture the decorative panel 10 of the present invention. The panel 10 may be prepared by differential heating and uniform compression. As a specific example, the panel 10 shown in FIG. 1 is prepared by heating one side of the blanket layer 12, i.e., the side to include the heat-seared, densified surface zone 14, while the other side remains relatively cool. A pressure is then applied for sufficient time to allow the polymer binding fiber to soften near the hot surface but not near the cold surface. When this occurs under compression, the hot side is reshaped into a higher density surface layer 14. The cool side of the polymer binding fiber does not soften and, therefore, when the pressure is removed, the base zone 16 retains most of its original thickness and density characteristics. The intermediate zone 18 undergoes only moderate densification. This technique may be performed in a standard molding press where one platen runs hot and the other runs cool. In this manner, it is possible to provide the surface zone 14 of the polymer based blanket layer 12 with a density of between about 1.5 pcf and about 15.0 pcf. This is followed by the printing of a selected face of the facing layer with desired graphics, patterns, designs or indicia.

More specifically, printing 22 may be provided with virtually any color or pattern and in a high level of detail. For example, patterns representing fabric, stone, marble, granite, wood as well as abstract color patterns and fictional or actual photographs may be printed on the exposed face 20 of the surface zone 14. The subject matter capable of being printed on the exposed face 20 is only limited by one's imagination. The printing may be completed by substantially any known printing process suitable for printing on the exposed face 20 of the densified polyester surface zone 14. Exemplary of these techniques, without being limiting, are laser printing, lithography, wallpaper printing processes and heat transfer processes.

In summary, numerous benefits result from employing the concepts of the present invention. The decorative panel 10 of the present invention has enhanced acoustical insulating properties which may be successfully tuned for particular applications. Further, the material will not delaminate thereby enhancing the service life of the final product. The densified surface zone 14 adds rigidity to the panel 10 so as to make the panel easier to handle thereby aiding trouble-free installation. The densified surface zone 14 also is relatively water-resistant and as such is also stain resistant. The densified surface zone 14 also provides the decorative panel 10 with good tackability so that it will not only receive but also hold fasteners and maintain its position following mounting to a wall stud, vehicle body panel or other support.

The foregoing description of the preferred embodiment of the invention has been presented for purposes of illustration and description. It is not intended to be exhaustive or to limit the invention to the precise form disclosed. Obvious modifications or variations are possible in light of the above teachings.

Figure 3:
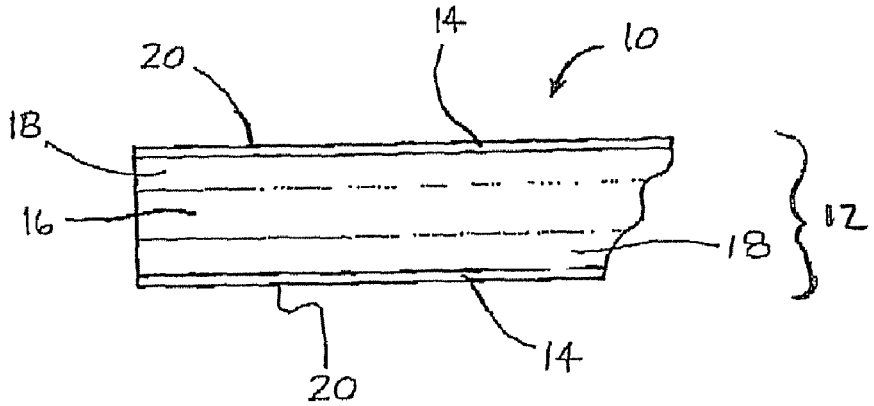
FIG. 3 shows a panel with a central base zone and opposing densified surface zone faces.

For example, while the decorative panel 10 is described and illustrated in FIG. 1 as incorporating only a single densified surface zone 14, base zone 16 and intermediate zone 18, the opposite side of the panel could also include a densified surface zone and an intermediate zone between that second densified surface zone and the base zone (see FIG. 3). This could be accomplished by passing the layer 12 of polymer based blanket material through the nip of two opposing heated pressure rolls. Those rolls provide sufficient pressure to compress the blanket material and sufficient heat to cause melting of the low temperature component of the bicomponent fibers at least in the surface zone. Of course, the melted component would need to set before releasing the pressure rolls in order to densify the surface zones 14 to the desired level. Under these circumstances, some densification would also take place in the two intermediate zones 18 while the base zone 16 would essentially return to its original density. Either or both of the exposed faces 20 of the densified surface zones 14 could include printing 22.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A decorative panel, comprising:

a body constructed from a single layer of a polymer based blanket material, said body including at least one densified surface zone, at least one base zone; and at least one intermediate zone between said densified surface zone and said base zone;

wherein the density of said densified surface zone is greater than the density of said intermediate zone, the density of said intermediate zone is greater than the density of said base zone, and said densified surface zone has an exposed face and printing applied to said exposed face of said densified surface zone.

2. The panel of claim 1, wherein said polymer based blanket material is selected from a group of materials consisting of polyester, polyolefin, polypropylene, polyethylene, fiberglass, acrylic, natural fibers, nylon, rayon and blends thereof.

3. The panel of claim 1, wherein said polymer based blanket material includes polyester staple fibers and polyester bicomponent fibers.

4. The panel of claim 3, wherein said polyester staple fibers and said polyester bicomponent fibers have diameters of between about 8.0 to about 30 microns and lengths between about 1.25 and about 8.0 cm.

5. The panel of claim 4 wherein said polymer based blanket material includes melt blown microfibers.

6. The panel of claim 3 wherein said polymer based blanket material includes melt blown microfibers.

7. The panel of claim 1, wherein said densified surface zone has a density of between about 1.5 and 15.0 pcf.

8. The panel of claim 1, wherein said printing is a decorative pattern.

9. A decorative panel, comprising:

a body constructed from a single layer of a polymer based blanket material, said body including;

a densified surface zone having a first density A;

a base zone having a density B; and an intermediate zone between said densified surface zone and said base zone having a density C where A is greater than C, and C is greater than B;

said panel being further characterized by;

printing directly applied to an exposed face of said densified surface zone.

10. The panel of claim 9 wherein said densified surface zone has a thickness of between about 0.038 and about 0.38 cm.

11. The panel of claim 10, wherein said base zone has a thickness of between about 0.38 and about 5.08 cm.

12. The panel of claim 11, wherein said intermediate zone has a thickness of between about 0.127 and about 1.27 cm.

13. The panel of claim 9, wherein said base zone has a thickness of between about 0.38 and about 5.08 cm.

14. The panel of claim 9, wherein said intermediate zone has a thickness of between about 0.127 and about 1.27 cm.

15. The panel of claim 9, wherein said polymer based blanket material is selected from a group of materials consisting of polyester, polyolefin, polypropylene, polyethylene, fiberglass, acrylic natural fibers, nylon, rayon and blends thereof.

16. The panel of claim 15, wherein said densified surface zone includes fibers having a diameter D, said base zone includes fibers having a diameter E and said intermediate zone includes fibers having a diameter F where F is greater than E, and E is greater than D.

17. The panel of claim 15, wherein said densified surface zone includes fibers having a diameter of between about 5.0 to about 25.0 microns and a length of between about 1.27 to about 6.35 cm.

18. The panel of claim 15, wherein said base zone includes fibers having a diameter of between about 10.0 and about 50.0 microns and a length of between about 2.54 and about 7.62 cm.

19. The panel of claim 15, wherein said intermediate zone includes fibers having a diameter of between about 10.0 and about 50.0 microns and a length of between about 2.54 and about 7.62 cm.

20. The panel of claim 15, wherein said densified surface zone includes fibers having a diameter of between about 5.0 to about 25.0 microns and a length of between about 1.27 to about 6.35 cm, said base zone includes fibers having a diameter of between about 10.0 and about 50.0 microns and a length of between about 2.54 and about 7.62 cm, and said intermediate zone includes fibers having a diameter of between about 10.0 and about 50.0 microns and a length of between about 2.54 and about 7.62 cm.

21. A decorative panel, comprising: a body constructed from a single layer of a polymer based blanket material including a first densified surface zone having a first exposed face, a first intermediate zone less dense than the first densified surface zone, a second densified surface zone having a second exposed face, a second intermediate zone less dense than the second densified surface zone, and a base zone less dense than the first intermediate zone and the second intermediate zone..

22. The panel according to claim 1, wherein the densified surface zone is thinner than at least one of the intermediate zone and the base zone.

23. The panel according to claim 1, wherein the exposed face is substantially planar.

24. The panel according to claim 21, further including printing on at least one of said densified surface zones.

25. The panel according to claim 21, wherein the second exposed face is opposite the first exposed face.

26. A panel, comprising: a body constructed from a single layer of a polymer based blanket material, said body including at least one densified surface zone, at least one base zone, and at least one intermediate zone between the densified surface zone and the base zone; wherein the density of the densified surface zone is greater than the density of the intermediate zone and the density of the intermediate zone is greater than the density of the base zone.

27. The panel according to claim 26, wherein the densified surface zone includes an exposed face for printing thereon.

* * * * *